US006003913A

United States Patent [19]

Flumiani

[11] Patent Number: 6,003,913

[45] Date of Patent: Dec. 21, 1999

[54] REFUSE COLLECTING DEVICE

[76] Inventor: Sergio J. Flumiani, 1715 Danthorpe Dr., Mississauga, Ontario LSN 7L2, Canada

[21] Appl. No.: 09/199,246

[22] Filed: Nov. 25, 1998

[51] Int. Cl.[6] ..... A01K 29/00; E01H 1/12

[52] U.S. Cl. ..... 294/1.4; 294/55

[58] Field of Search ..... 294/1.1, 1.3–1.5, 294/19.1, 19.2, 55, 55.5; 15/104.8, 257.1, 257.3, 257.4, 257.7; 56/327.1, 328.1, 400.01, 400.04, 400.11, 400.21, 332; 209/417–419

[56] References Cited

U.S. PATENT DOCUMENTS

| | | | |
|---|---|---|---|
| 4,149,745 | 4/1979 | Willis | 294/1.4 |
| 4,279,437 | 7/1981 | Goldbarg | 294/1.4 |
| 4,316,627 | 2/1982 | Solypa | 294/1.4 |
| 5,417,044 | 5/1995 | Russo | 294/55 X |
| 5,868,447 | 2/1999 | Clark et al. | 294/1.4 |

OTHER PUBLICATIONS

Aaron's Industries, Inc., makers of S.A.S.I. Scoop–Scoop and sack it. Color brochure. P.O. Box 1180 Broomfield, CO 80038–1180.

*Primary Examiner*—Johnny D. Cherry

[57] ABSTRACT

A refuse collecting device for collecting pet droppings from the ground. The refuse collecting device includes annular front and back bands with a plurality of spaced apart connecting rods extending therebetween to connect the front and back bands together. The end of an elongate shaft is coupled to the front band. A plurality of spaced apart elongate tines are outwardly extended from a front edge of the front band.

10 Claims, 2 Drawing Sheets

REFUSE COLLECTING DEVICE

BACKGROUND OF THE INVENTION

1. Field of the Invention

The present invention relates to refuse collecting devices and more particularly pertains to a new refuse collecting device for collecting pet droppings from the ground.

2. Description of the Prior Art

The use of refuse collecting devices is known in the prior art. More specifically, refuse collecting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,900,077; U.S. Pat. No. 3,986,744; U.S. Pat. No. 4,279,437; U.S. Pat. No. 4,149,745; U.S. Pat. No. Des. 299,075; and U.S. Pat. No. 2,020,293.

While these devices fulfill their respective, particular objectives and requirements, the aforementioned patents do not disclose a new refuse collecting device. The inventive device includes annular front and back bands with a plurality of spaced apart connecting rods extending therebetween to connect the front and back bands together. One end of an elongate shaft is coupled to the front band. A plurality of spaced apart elongate tines are outwardly extended from a front edge of the front band.

In these respects, the refuse collecting device according to the present invention substantially departs from the conventional concepts and designs of the prior art, and in so doing provides an apparatus primarily developed for the purpose of collecting pet droppings from the ground.

SUMMARY OF THE INVENTION

In view of the foregoing disadvantages inherent in the known types of refuse collecting devices now present in the prior art, the present invention provides a new refuse collecting device construction wherein the same can be utilized for collecting pet droppings from the ground.

The general purpose of the present invention, which will be described subsequently in greater detail, is to provide a new refuse collecting device apparatus and method which has many of the advantages of the refuse collecting devices mentioned heretofore and many novel features that result in a new refuse collecting device which is not anticipated, rendered obvious, suggested, or even implied by any of the prior art refuse collecting devices, either alone or in any combination thereof.

To attain this, the present invention generally comprises annular front and back bands with a plurality of spaced apart connecting rods extending therebetween to connect the front and back bands together. One end of an elongate shaft is coupled to the front band. A plurality of spaced apart elongate tines are outwardly extended from a front edge of the front band.

There has thus been outlined, rather broadly, the more important features of the invention in order that the detailed description thereof that follows may be better understood, and in order that the present contribution to the art may he better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new refuse collecting device apparatus and method which has many of the advantages of the refuse collecting devices mentioned heretofore and many novel features that result in a new refuse collecting device which is not anticipated, rendered obvious, suggested, or even implied by any of the prior art refuse collecting devices, either alone or in any combination thereof.

It is another object of the present invention to provide a new refuse collecting device which may be easily and efficiently manufactured and marketed.

It is a further object of the present invention to provide a new refuse collecting device which is of a durable and reliable construction.

An even further object of the present invention is to provide a new refuse collecting device which is susceptible of a low cost of manufacture with regard to both materials and labor, and which accordingly is then susceptible of low prices of sale to the consuming public, thereby making such refuse collecting device economically available to the buying public.

Still yet another object of the present invention is to provide a new refuse collecting device which provides in the apparatuses and methods of the prior art some of the advantage s thereof, while simultaneously overcoming some of the disadvantages normally associated therewith.

Still another object of the present invention is to provide a new refuse collecting device for collecting pet droppings from the ground.

Yet another object of the present invention is to provide a new refuse collecting device which includes annular front and back bands with a plurality of spaced apart connecting rods extending therebetween to connect the front and back bands together. One end of an elongate shaft is coupled to the front band. A plurality of spaced apart elongate tines are outwardly extended from a front edge of the front band.

Still yet another object of the present invention is to provide a new refuse collecting device that lets a user collect pet feces from the ground without having to have their hands come in contact with the feces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
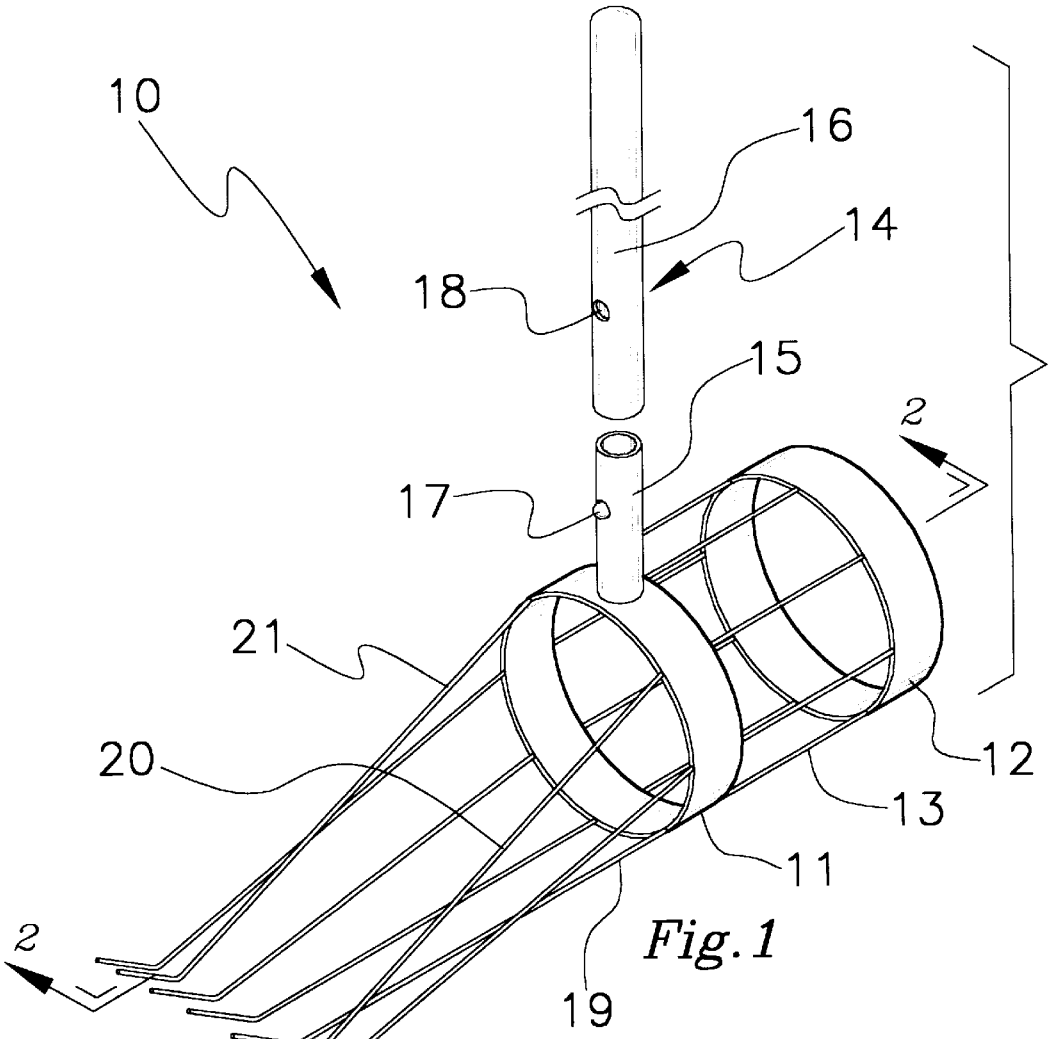
FIG. 1 is a schematic partial perspective view of a new refuse collecting device according to the present invention.
Figure 2:
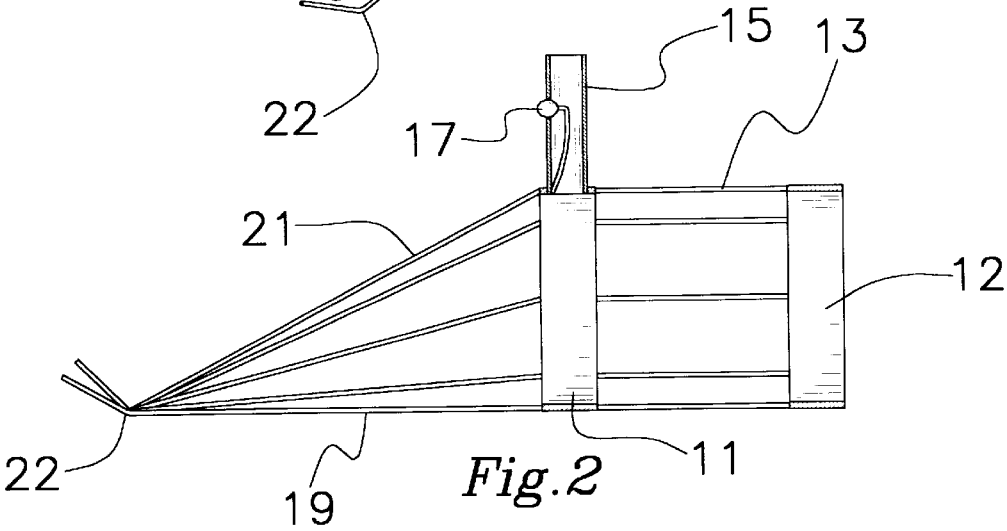
FIG. 2 is a schematic cross sectional view of the present invention taken from line 2–2 of FIG. 1.
Figure 3:
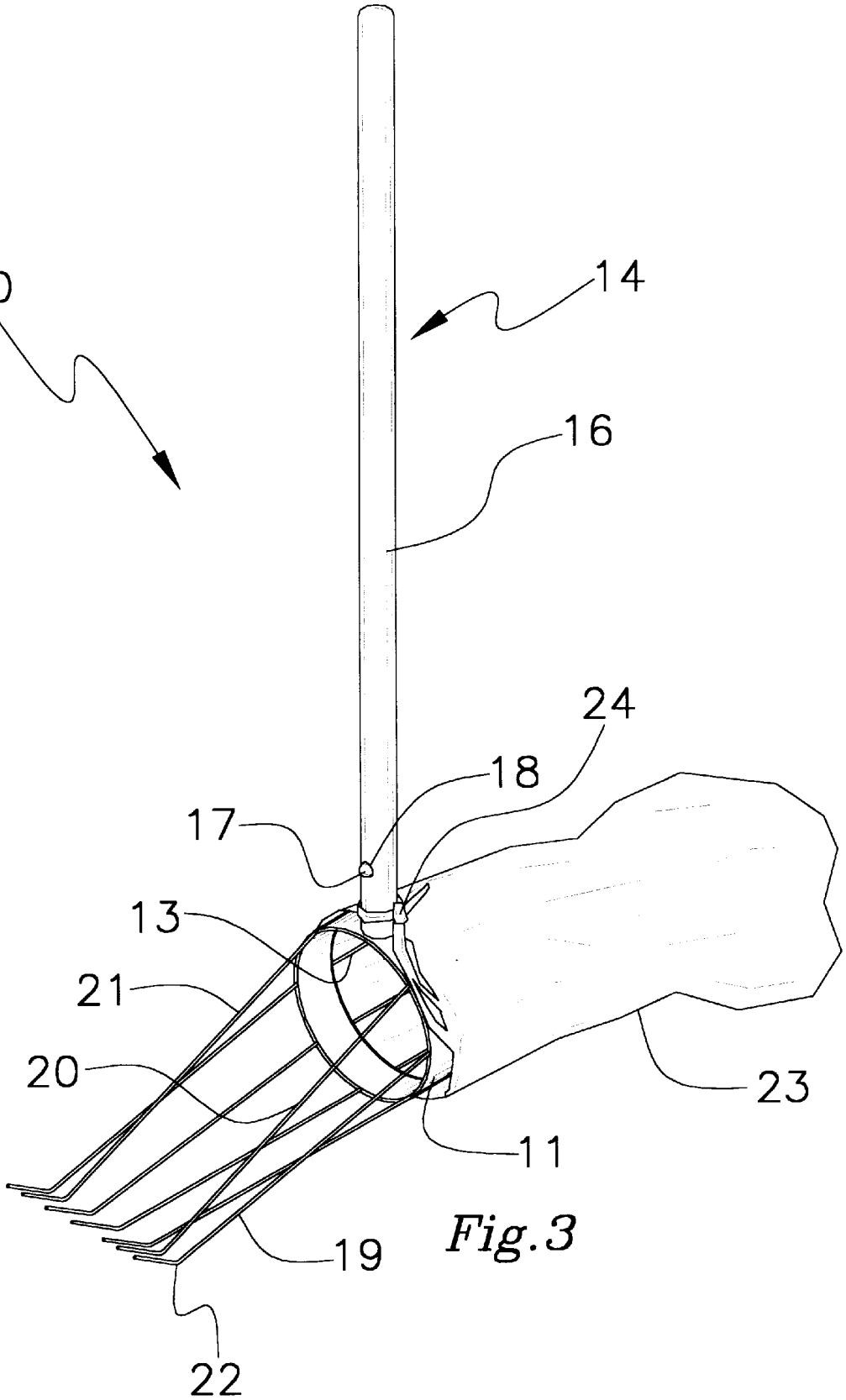
FIG. 3 is a schematic perspective view of the present invention.

With reference now to the drawings, and in particular to FIGS. 1 through 3 thereof, a new refuse collecting device embodying the principles and concepts of the present invention and generally designated by the reference numeral 10 will be described.

As best illustrated in FIGS. 1 through 3, the refuse collecting device 10 generally comprises annular front and back bands with a plurality of spaced apart connecting rods extending therebetween to connect the front and back bands together. One end of an elongate shaft is coupled to the front band. A plurality of spaced apart elongate tines are outwardly extended from a front edge of the front band.

In use, the refuse collecting device 10 is designed for collecting pet droppings from a ground surface. In closer detail, the refused collecting device comprise annular frost and back bands 11,12 each being generally circular and each having generally smooth and generally cylindrical inner and outer surfaces, generally circular front and back edges, a diameter, and a circumference. Preferably, the front and back bands are generally coaxially aligned with one another. In one preferred embodiment, the diameters of the front and back bands are about equal to one another. In an illustrative ideal embodiment, the diameters of the front and back band are each about 3 inches. Optionally, the diameter of the back band may be less than the diameter of the front band. In this optional embodiment, ideally, the diameter of the front band is about 3 inches and the diameter of the back band is about 2 inches.

A plurality of spaced apart connecting rods 13 are extended between the back edge of the front band and the front edge of the back band to connect the front and back bands together. The connecting rods are preferably extended substantially parallel to one another. Ideally, the connecting rods are spaced apart along the circumferences of the front and back bands at generally equal intervals. In an ideal illustrative embodiment, the plurality of connecting rods comprises eight connecting rods to form a sufficiently strong coupling between the front and back bands.

A first end of an elongate shaft 14 is coupled to the outer surface of the front band. The shaft also has a second end opposite the first end and a longitudinal axis extending between the ends of the shaft. Preferably, the shaft is tubular and has a generally circular transverse cross section taken substantially perpendicular to the longitudinal axis of the shaft. The longitudinal axis of the shaft is preferably extended radially outwards from the front band so that the front band and the shaft generally lie in a common plane with one another. In use, the shaft is designed for grasping with the hands of the user adjacent the second end of the shaft.

In a preferred embodiment, the shaft has separable first and second portions 15,16. The first portion of the shaft is positioned adjacent the first end of the shaft and the second portion of the shaft is positioned adjacent a second of the ends of the shaft. The first portion of the shaft is inserted into the second portion of the shaft. Preferably, the shaft has a spring biased pin detent 17 detachably coupling the first and second portions of the shaft together. The pin detent is preferably coupled to the first portion of the shaft and is insertable into a hole 18 in the second portion of the shaft to couple the first and second portions of the shaft together.

The shaft has a length defined between the ends of the shaft. The first and second portions of the shaft each have a length defined along the longitudinal axis of the shaft. The length of the second portion of the shaft is preferably at least three times greater than the length of the first portion of the shaft. Ideally, the length of the shaft is about 30 inches with the length of the first portion of the shaft between about 1½ inches and about 2 inches.

A plurality of spaced apart elongate tines 19 are outwardly extended from the front edge of the front band. Each of the tines has opposite proximal and distal ends and a longitudinal axis extending between the proximal and distal ends of the respective tine. The proximal ends of the tines are coupled to the front edge of the front band. The tines are arranged in a generally C-shaped row along the circumference of the front band. The C-shaped row of the tines has a pair of opposite terminal tines 20,21 defining a break therebetween in the C-shaped row. Preferably, the longitudinal axes of the terminal tines are extended generally parallel to one another. The break of the C-shaped row is positioned adjacent the first end of the shaft.

Each of the tines has an upwardly extending bend 22 located towards the distal end of the respective tine. The bends of the tines generally lie along a line extending substantially perpendicular to a plane in which the front edge of the front band lies and substantially perpendicular to the common axis of the front and back bands.

The bend of each tine divide the respective tine into elongate proximal and distal portions extending at an obtuse angle to one another. The proximal portion of each tine is positioned adjacent the proximal end of the respective tine and the distal portion of each tine is positioned adjacent the distal end of the respective tine.

Also, the distal ends of the terminal tines preferably define a line extending substantially perpendicular to the plane of the front edge of the front band. In this preferred embodiment, the distal ends of a remainder of the tines of the plurality of tines also define a line extending substantially perpendicular to the plane of the front edge of the front band. The line of the distal ends of the terminal tines and the line of the distal ends of the remainder tines lie in planes substantially parallel to one another.

Also provided is a flexible bag 23 with an opening therein. The back band and the connecting rods are extended into the flexible bag through the opening of the flexible bag. As illustrated in FIG. 3, the opening of the flexible bag is extended around the outer surface of the front band. The opening of the flexible bag is secured around the front band. Ideally, a portion 24 of the flexible bag adjacent the opening of the flexible bag is tied to the shaft adjacent the first end of the shaft to secure the opening of the flexible bag around the front band.

In use, a user grasps the shaft adjacent the second end of the shaft and uses the shaft to maneuver the distal ends of the tines toward the pet droppings on a ground surface. The user then scoops up the dropping with the tines into the flexible bag, which may be detached from around the front bag when the collection of droppings has been completed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collecting device, comprising:

annular front and back bands each having front and back edges;

a plurality of spaced apart connecting rods being extended between said back edge of said front band and said front edge of said back band to connect said front and back bands together;

an elongate shaft having a pair of opposite ends and a longitudinal axis extending between said ends of said shaft;

a first of said ends of said shaft being coupled to said front band;

a plurality of spaced apart elongate tines being outwardly extended from said front edge of said front band;

each of said tines having opposite proximal and distal ends and a longitudinal axis extending between the proximal and distal ends of the respective tine, said proximal ends of said tines being coupled to said front edge of said front band; and said tines being arranged in a generally C-shaped row along said front band, said C-shaped row of said tines having a pair of opposite terminal tines defining a break therebetween in said C-shaped row.

2. The collecting device of claim 1, wherein said front and back bands are generally coaxially aligned with one another.

3. The collecting device of claim 1, wherein said front and back bands each have a diameter, said diameters of said front and back bands being about equal to one another.

4. The collecting device of claim 1, wherein said connecting rods are extended substantially parallel to one another.

5. The collecting device of claim 1, wherein said shaft has separable first and second portions, said first portion of said shaft being positioned adjacent said first end of said shaft, said second portion of said shaft being positioned adjacent a second of said ends of said shaft, and wherein said first portion of said shaft is inserted into said second portion of said shaft.

6. The collecting device of claim 5, wherein said first and second portions of said shaft each have a length defined along said longitudinal axis of said shaft, said length of said second portion of said shaft being at least three times greater than said length of said first portion of said shaft.

7. The collecting device of claim 1, wherein each of said tines has a bend located towards said distal end of the respective tine, said bends of said tines generally lying along a line extending substantially perpendicular to a plane in which said front edge of said front band lies.

8. The collecting device of claim 1, further comprising a flexible bag having an opening therein, said back band and said connecting rods being extended into said flexible bag through said opening of said flexible bag, said opening of said flexible bag being extended around said front band.

9. The collecting device of claim 8, wherein a portion of said flexible bag adjacent said opening of said flexible bag is tied to said shaft adjacent said first end of said shaft to secure said opening of said flexible bag around said front band.

10. A collecting device, comprising:

annular front and back bands each being generally circular and each having generally smooth and generally cylindrical inner and outer surfaces, generally circular front and back edges, a diameter, and a circumference;

said front and back bands being generally coaxially aligned with one another;

said diameters of said front and back bands being about equal to one another;

a plurality of spaced apart connecting rods being extended between said back edge of said front band and said front edge of said back band to connect said front and back bands together;

said connecting rods each being extended substantially parallel to one another, said connecting rods being spaced apart along said circumferences of said front and back bands at generally equal intervals;

wherein said plurality of connecting rods comprises eight connecting rods;

an elongate shaft having a pair of opposite ends and a longitudinal axis extending between said ends of said shaft;

said shaft being tubular and having a generally circular transverse cross section taken substantially perpendicular to said longitudinal axis of said shaft;

a first of said ends of said shaft being coupled to said outer surface of said front band, said longitudinal axis of said shaft being extended radially outwards from said front band, said front band and said shaft generally lying in a common plane with one another;

said shaft having separable first and second portions, said first portion of said shaft being positioned adjacent said first end of said shaft, said second portion of said shaft being positioned adjacent a second of said ends of said shaft;

said first portion of said shaft being inserted into said second portion of said shaft;

said shaft having a spring biased pin detent detachably coupling said first and second portions of said shaft together;

said first and second portions of said shaft each having a length defined along said longitudinal axis of said shaft, said length of said second portion of said shaft being at least three times greater than said length of said first portion of said shaft;

a plurality of spaced apart elongate tines being outwardly extended from said front edge of said front band;

each of said tines having opposite proximal and distal ends and a longitudinal axis extending between the proximal and distal ends of the respective tine, said proximal ends of said tines being coupled to said front edge of said front band;

said tines being arranged in a generally C-shaped row along said circumference of said front band, said C-shaped row of said tines having a pair of opposite terminal tines defining a break therebetween in said C-shaped row;

said break of said C-shaped row being positioned adjacent said first end of said shaft;

said longitudinal axis of said terminal tines being extended generally parallel to one another;

each of said tines having a bend located towards said distal end of the respective tine;

said bends of said tines generally lying along a line extending substantially perpendicular to a plane in which said front edge of said front band lies;

said distal ends of said terminal tines defining a line extending substantially perpendicular to said plane of said front edge of said front band;

said distal ends of a remainder of said tines of said plurality of tines defining a line extending substantially perpendicular to said plane of said front edge of said front band;

said line of said distal ends of said terminal tines and said line of said distal ends of said remainder tines lying in planes substantially parallel to one another;

said longitudinal axes of said terminal tines converging towards one another in a direction from said proximal ends of said terminal tines towards said distal ends of said tines;

a flexible bag having an opening therein;

said back band and said connecting rods being extended into said flexible bag through said opening of said flexible bag;

said opening of said flexible bag being extended around said outer surface of said front band; and wherein a portion of said flexible bag adjacent said opening of said flexible bag is tied to said shaft adjacent said first end of said shaft to secure said opening of said flexible bag around said front band.

* * * * *